US010131979B2

(12) United States Patent
Kurz et al.

(10) Patent No.: US 10,131,979 B2
(45) Date of Patent: Nov. 20, 2018

(54) THERMOMECHANICAL ROLLING OF AN ALUMINUM PLATE

(71) Applicant: SIEMENS AKTIENGESELLSCHAFT, München (DE)

(72) Inventors: Matthias Kurz, Erlangen (DE); Birger Schmidt, Brand-Erbisdorf (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 496 days.

(21) Appl. No.: 14/397,084

(22) PCT Filed: Apr. 17, 2013

(86) PCT No.: PCT/EP2013/057960
§ 371 (c)(1),
(2) Date: Oct. 24, 2014

(87) PCT Pub. No.: WO2013/160162
PCT Pub. Date: Oct. 31, 2013

(65) Prior Publication Data

US 2015/0122375 A1 May 7, 2015

(30) Foreign Application Priority Data

Apr. 26, 2012 (EP) ..... 12165758

(51) Int. Cl.
*C22F 1/04* (2006.01)
*B21B 3/00* (2006.01)
*B21B 38/00* (2006.01)

(52) U.S. Cl.
CPC ..... *C22F 1/04* (2013.01); *B21B 3/00* (2013.01); *B21B 38/006* (2013.01); *B21B 2003/001* (2013.01); *B21B 2201/06* (2013.01)

(58) Field of Classification Search
CPC ..... C22F 1/00; C22F 1/04; C22F 1/043
USPC ..... 148/510
See application file for complete search history.

(56) References Cited

U.S. PATENT DOCUMENTS

| | | | | |
|---|---|---|---|---|
| 8,145,346 | B2 * | 3/2012 | Kurz | B21B 37/00 29/527.7 |
| 2009/0326700 | A1 | 12/2009 | Kurz et al. | |
| 2010/0077823 | A1 * | 4/2010 | Champion | B21B 39/004 72/201 |

FOREIGN PATENT DOCUMENTS

| | | | |
|---|---|---|---|
| EP | 1 958 711 | A1 | 8/2008 |
| EP | 2 305 392 | A1 | 4/2011 |
| EP | 2 111 309 | B1 | 11/2011 |
| EP | 12165758 | | 4/2012 |
| WO | 2008/043684 | A1 | 4/2008 |

OTHER PUBLICATIONS

Search Report for European Patent Application No. 12165758.9 dated Oct. 24, 2012.
International Search Report for PCT/EP2013/057960 dated Jul. 24, 2013.

* cited by examiner

*Primary Examiner* — Weiping Zhu
(74) *Attorney, Agent, or Firm* — Staas & Halsey LLP

(57) ABSTRACT

In a rolling process for reverse thermomechanically rolling an aluminum plate involving a plurality of rolling passes, identifying data are determined for thermally guiding the rolling process. Then a value of a state variable, from which a temperature of the aluminum plate can be deduced, is continuously measured and a pass schedule is determined for the rolling process on the basis of the value of the measured state variable and of the identifying data. The pass schedule provides for a rolling pause between at least two successive rolling passes, during which rolling of the aluminum plate is interrupted for cooling purposes.

14 Claims, 1 Drawing Sheet

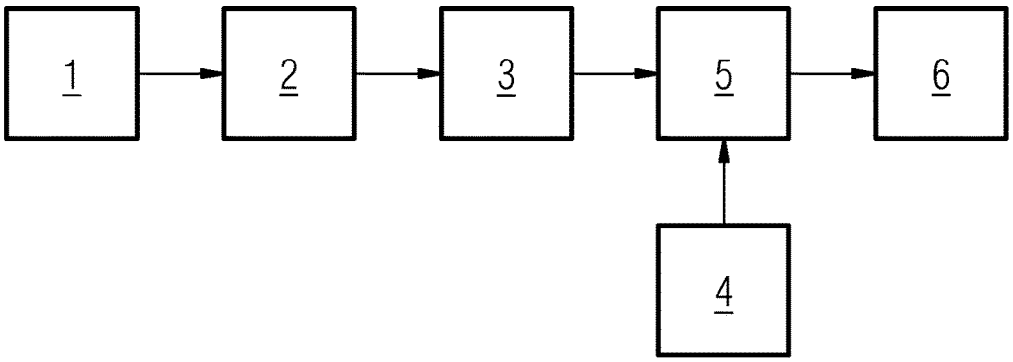
1
2
3
5
6
4

THERMOMECHANICAL ROLLING OF AN ALUMINUM PLATE

CROSS REFERENCE TO RELATED APPLICATIONS

This application is the U.S. national stage of International Application No. PCT/EP2013/057960, filed Apr. 17, 2013 and claims the benefit thereof. The International Application claims the benefit of European Application No. 12165758 filed on Apr. 26, 2012, both applications are incorporated by reference herein in their entirety.

BACKGROUND

Described below is a method for reversing thermomechanical rolling of an aluminum plate in a rolling process comprising a plurality of rolling passes.

Various methods for reversing thermomechanical rolling are known. WO 2008/043684, for example, discloses a method for monitoring the physical state of a hot-rolled plate or hot-rolled strip within the scope of controlling a rolling train for reversing working of a hot-rolled plate or hot-rolled strip. In the method, an initial state of the hot-rolled plate or hot-rolled strip, from which at least one physical state variable can be derived, is determined in a model at a starting point and the state is updated cyclically using the model during the working of the hot-rolled plate, a tracking of the hot-rolled plate or hot-rolled strip and the operating parameters influencing and/or reflecting the state being taken into account.

EP 2 111 309 B1 discloses a method for thermomechanically controlled rolling of a batch of metal slabs into plates or strips in a rolling mill having at least one rolling mill stand in accordance with a rolling pattern which comprises at least two rolling phases and is applied to each slab of the batch. During the rolling of the batch on at least one rolling mill stand it happens a plurality of times that a rolling phase that is applied to one slab or plate or strip is succeeded by another rolling phase that is applied to another slab or plate or strip on the rolling mill stand. In this case, for two successively rolled slabs, the time gap between the starting times of their rolling phases is always less than the sum of the durations of all rolling phases and all cooling phases of the rolling pattern.

EP 1 958 711 A1 discloses a method for thermomechanically controlled rolling of metal slabs, wherein each metal slab is rolled during at least two rolling phases which are interrupted by a cooling phase and a plurality of metal slabs are rolled simultaneously.

EP 2 305 392 A1 discloses a method for rolling stock, wherein the rolling process includes a cooling phase between two hot-rolling reshaping phases. During the cooling phase a temperature difference between a central region and an edge region of the rolling stock is counteracted by application of heat to the edge region.

SUMMARY

Described below is an improved method for reversing thermomechanical rolling of an aluminum plate.

In the method for reversing thermomechanical rolling of an aluminum plate in a rolling process comprising a plurality of rolling passes, characteristic data for thermally controlling the rolling process is specified and values of at least one state variable from which a temperature of the aluminum plate can be derived are determined continuously. A pass schedule for the rolling process is determined as a function of the determined values of the at least one state variable and the characteristic data, provision being made in the pass schedule for a rolling pause between at least two successive rolling passes, during which rolling pause the rolling of the aluminum plate is interrupted to allow the plate to cool down. In this case the characteristic data assigns a waiting thickness of the aluminum plate to at least one rolling pass, and the pass schedule makes provision for a rolling pause to start as soon as the thickness of the aluminum plate reaches or falls below its assigned waiting thickness in the rolling pass.

What is understood by an aluminum plate in this application is a plate of aluminum or an aluminum alloy.

The determined state variable may be a temperature averaged over a thickness of the aluminum plate or a surface temperature or a residual hardening or phase fractions or grain sizes or an enthalpy of the aluminum plate.

In the method, an aluminum plate is therefore rolled in a temperature-controlled manner. This enables the temperature of the aluminum plate to be monitored and controlled during the rolling process. In this case the temperature is controlled by rolling pauses in which the aluminum plate is cooled. This is advantageous since, as is generally known, the rolling temperature has a significant influence on the material properties of aluminum plates. In particular the temperature of the aluminum plate can be controlled during the rolling process in such a way that post-processing steps known from the prior art that succeed the rolling for the purpose of thermally generating specific mechanical properties of the material of the aluminum plate are rendered superfluous. Manufacturing steps of such type are, for example, solution annealing, quench hardening or curing of the aluminum.

Furthermore, the insertion of rolling pauses is coupled to the achieving of predefined thicknesses of the aluminum plate. This advantageously enables a staged rolling of the aluminum plate to be realized in which, in order to allow the aluminum to cool down, the rolling process is interrupted in a controlled manner by rolling pauses as a function of the temperature and thickness of the aluminum plate.

An embodiment provides that the characteristic data assigns a rolling restart temperature of the aluminum plate to at least one rolling pause, and that the pass schedule makes provision for the rolling pause to terminate as soon as the temperature of the aluminum plate reaches the rolling restart temperature.

What is achieved in this way is that during a rolling pause the aluminum plate cools down to a defined temperature, specifically to its assigned rolling restart temperature. The monitoring and control of the temperature of the aluminum plate during the rolling process is advantageously improved as a result.

A further embodiment provides that the characteristic data includes a target temperature, and that the pass schedule determines a duration of a rolling pause or a rolling restart temperature of the aluminum plate after a rolling pause such that after the final rolling pass the temperature of the aluminum plate coincides with the target temperature. As a result, it is possible to achieve not only a defined end thickness, but also a target temperature of the aluminum plate in the final rolling pass. This enables advantageous material properties of the aluminum to be set already at the end of the rolling process, without labor-intensive and costly post-processing. By at least approximating the target temperature it is furthermore possible, given a suitable pass schedule strategy, to counteract unwanted grain growth in the aluminum plate, which can occur in the case of conventional methods in a heat treatment stage following the rolling process.

A further embodiment provides that the characteristic data includes a cooling temperature, and that after the final rolling pass the aluminum plate is supplied to a cooling unit and cooled down to the cooling temperature by the cooling unit. In this case the characteristic data may also include a cooling rate and after the final rolling pass the aluminum plate is cooled down to the cooling temperature at the cooling rate by the cooling unit.

This advantageously enables the material properties of the aluminum to be further improved by a controlled cooling phase after the rolling process.

Another embodiment provides that during at least one rolling pause at least one rolling pass of another aluminum plate is performed. For this purpose a method for rolling a plurality of aluminum plates known from EP 2 111 309 B1 is applied, for example.

As a result rolling pauses can advantageously be used for processing further aluminum plates, thereby enabling optimized utilization of the capacity of a rolling train.

A further embodiment provides that a rolling force threshold value is predefined as a function of at least one state variable of the aluminum plate, and that the pass schedule limits the rolling force during the rolling operation to the respective rolling force threshold value as a function of the values of the at least one state variable. Alternatively or in addition, a thickness reduction threshold value is predefined as a function of at least one state variable of the aluminum plate and the reduction of a thickness of the aluminum plate during each rolling pass is limited by the pass schedule to the respective thickness reduction threshold value as a function of the values of the at least one state variable.

In this case a thickness of the aluminum plate may be used as a state variable. Alternatively or in addition, other geometric variables, e.g. a curvature or a profile of the aluminum plate, or thermodynamic variables, e.g. a temperature of the aluminum plate, are suitable as the state variable.

By this method, the material properties of the aluminum can be further improved and in particular an unwanted grain growth in the aluminum plate can be counteracted.

A further embodiment provides that the aluminum plate is cooled by a cooling unit during at least one rolling pause.

The use of cooling units for cooling down the aluminum plate is advantageous because aluminum plates are generally rolled at relatively low temperatures and a passive cooling of the aluminum plates would therefore cost too much time.

A further embodiment provides that measured values of at least one measurement variable associated with a temperature of the aluminum plate are acquired continuously and the values of the at least one state variable are determined on the basis of the acquired measured values by a temperature model evaluating the measured values. A method for monitoring the physical state of the aluminum plate known from WO 2008/043684 is particularly suitable for determining a current temperature of the aluminum plate.

Methods of the type for determining a current temperature of the aluminum plate on the basis of a temperature model are advantageous in particular because a sufficiently accurate direct measurement of a temperature of aluminum plates is usually difficult or overly complicated and for that reason having recourse to a model for determining the temperature is useful.

A further embodiment provides that the pass schedule is constantly updated, for example after each pass of the aluminum plate through a cooling unit.

An update of the type advantageously enables corrective interventions to be made in the event of deviations of actual data from planning data and the pass schedule to be adapted to the current conditions.

BRIEF DESCRIPTION OF THE DRAWINGS

The above-described characteristics, features and advantages, as well as the manner in which these are achieved, will become clearer and more readily understandable in connection with the following description of exemplary embodiments which are explained in more detail with reference to a drawing.

The FIGURE shows a flowchart of a method for reversing thermomechanical rolling of an aluminum plate into an aluminum sheet in a rolling process including a plurality of rolling passes, the method being performed by an automation system.

DETAILED DESCRIPTION OF THE PREFERRED EMBODIMENT

Reference will now be made in detail to the preferred embodiments, examples of which are illustrated in the accompanying drawings, wherein like reference numerals refer to like elements throughout.

The method entails the acquisition of measured values 1 of at least one measurement variable associated with a temperature of the aluminum plate. Measurement variables of the type are in particular temperatures at different locations on the aluminum plate and parameters that are characteristic of the aluminum plate, such as a microstructure.

A current temperature of the aluminum plate is determined as state variable 3 of the aluminum plate on the basis of the acquired measured values 1 by a temperature model 2 of the aluminum plate evaluating the measured values 1, as is known from WO 2008/043684.

Furthermore, characteristic data 4 for thermally controlling the rolling process is specified and stored in the automation system. The characteristic data comprises in particular waiting thicknesses, rolling restart temperatures, a target temperature, a cooling temperature, and a cooling rate.

A pass schedule 5 for the rolling process is determined based on the determined current temperature of the aluminum plate and the characteristic data 4, which pass schedule 5 also comprises final control elements 6 required for achieving the characteristic data 4. Such final control elements 6 include a cooling-down time in the case of air cooling of the aluminum plate, a number of rolling passes, a throughput rate of the aluminum plate through a rolling mill stand, and/or water volumes of a cooling unit.

On the basis of the pass schedule 5, the aluminum plate is rolled during each rolling pass until a waiting thickness assigned to the respective rolling pass is reached. The rolling of the aluminum plate is subsequently interrupted by a rolling pause until the plate has cooled down to a rolling restart temperature assigned to the rolling pause for initiation of the following rolling pass. In this case the aluminum plate can be cooled passively or actively by a cooling unit. The waiting thicknesses and rolling restart temperatures are dependent on the material and the target geometry of the aluminum plate. These variables can sometimes be derived from phase diagrams, in the case of aluminum plates made from aluminum-copper or aluminum-magnesium alloys, for example, but in general are determined empirically.

The rolling restart temperature of the final rolling pass is determined with the aid of the temperature model 2 such that the temperature of the aluminum plate after the final rolling coincides with the target temperature. The target temperature can be characterized e.g. by a temperature averaged over the thickness of the aluminum plate, by a surface temperature or by an enthalpy.

After the final rolling pass the aluminum plate is supplied to a cooling unit and cooled down to the cooling temperature at the cooling rate by the cooling unit.

In one exemplary embodiment the pass schedule also takes into account further characteristic data, e.g. a maximum rolling force acting on the aluminum plate and/or a maximum thickness reduction of the aluminum plate during the individual rolling passes, in addition to the characteristic data 4 for thermally controlling the rolling process.

In a further alternative or additional implementation of the exemplary embodiment the pass schedule is updated cyclically, e.g. after each pass of the aluminum plate through a cooling unit, on the basis of the determined current temperature, in particular the final control elements 6 for the further cooling phases also being updated in the process. In particular it is possible in this way in the event of a deviation of the actual data from the planning data to make repeated corrective interventions in order to achieve the target variables (in particular a target thickness and the target temperature of the aluminum plate).

In another alternative or additional embodiment of the exemplary embodiment at least one further aluminum plate is rough-rolled during the cooling-down of the aluminum plate in a rolling pause. The method for staggered rolling of a plurality of aluminum plates known from EP 2 111 309 B1 is used for this purpose.

Although the method has been illustrated and described in greater detail on the basis of a preferred exemplary embodiment, the method is not limited by the disclosed examples and other variations can be derived herefrom by the person skilled in the art without leaving the spirit and scope of protection of the claims which may include the phrase "at least one of A, B and C" as an alternative expression that means one or more of A, B and C may be used, contrary to the holding in Superguide v. DIRECTV, 358 F3d 870, 69 USPQ2d 1865 (Fed. Cir. 2004).

The invention claimed is:

1. A method for reversing thermomechanical rolling of an aluminum plate in a rolling process including a plurality of rolling passes, comprising:

specifying characteristic data, including a microstructure of the aluminum plate, a waiting thickness of the aluminum plate assigned to at least one rolling pass and at least one of rolling restart temperatures, a target temperature, a cooling temperature, and a cooling rate, for thermally controlling the rolling process;

continuously determining values of at least one state variable including measured surface temperature profiles of the aluminum plate, from which a temperature of the aluminum plate can be derived;

determining a pass schedule for the rolling process as a function of the characteristic data, including the waiting thickness of the aluminum plate assigned to at least one rolling pass and the at least one of rolling restart temperatures, the target temperature, the cooling temperature, and the cooling rate ,and the values of the at least one state variable obtained by said determining, including measured surface temperature profiles of the aluminum plate, the pass schedule making provision for a rolling pause between at least two successive rolling passes that starts as soon as a measured thickness of the aluminum plate is no longer above the waiting thickness assigned to a completed rolling pass, where during the rolling pause rolling of the aluminum plate is interrupted to allow the aluminum plate to cool down; and controlling the rolling process in accordance with the pass schedule, based on temperatures measured at different locations on the aluminum plate and the characteristic data, including the waiting thickness of the aluminum plate assigned to at least one rolling pass and the at least one of rolling restart temperatures, the target temperature, the cooling temperature, and the cooling rate.

2. The method as claimed in claim 1, wherein the characteristic data assigns a rolling restart temperature of the aluminum plate to at least one rolling pause, and wherein the pass schedule makes provision for the rolling pause to terminate as soon as the temperature of the aluminum plate reaches the rolling restart temperature.

3. The method as claimed claim 1, wherein the characteristic data includes a target temperature, and wherein the pass schedule determines a duration of at least one of the rolling pause and a rolling restart temperature of the aluminum plate after the rolling pause so that the temperature of the aluminum plate after a final rolling pass coincides with the target temperature.

4. The method as claimed claim 1, wherein the state variable is at least one of a temperature averaged over the measured thickness of the aluminum plate, a surface temperature, a residual hardening, phase fractions, grain sizes, and an enthalpy of the aluminum plate.

5. The method as claimed claim 1, wherein the characteristic data includes a cooling temperature, and further comprising, after a final rolling pass, supplying the aluminum plate to a cooling unit and cooling to the cooling temperature by the cooling unit.

6. The method as claimed in claim 5, wherein the characteristic data includes a cooling rate, and wherein in said cooling after the final rolling pass, the aluminum plate is cooled down to the cooling temperature at the cooling rate by the cooling unit.

7. The method as claimed claim 1, further comprising, performing at least one rolling pass of another aluminum plate during at least one rolling pause.

8. The method as claimed claim 1, further comprising predefining a rolling force threshold value as a function of at least one state variable of the aluminum plate, and wherein the pass schedule limits a rolling force during the rolling operation to a respective rolling force threshold value as a function of the values of the at least one state variable.

9. The method as claimed in claim 8, wherein the measured thickness of the aluminum plate is used as a state variable.

10. The method as claimed claim 1, further comprising predefining a thickness reduction threshold value as a function of at least one state variable of the aluminum plate, and wherein the pass schedule limits a reduction of the measured thickness of the aluminum plate during each rolling pass to a respective thickness reduction threshold value as a function of the values of the at least one state variable.

11. The method as claimed in claim 10, wherein the measured thickness of the aluminum plate is used as a state variable.

12. The method as claimed claim 1, further comprising cooling the aluminum plate by a cooling unit during at least one rolling pause.

13. The method as claimed claim 1, further comprising continuously acquiring measured values of at least one measurement variable associated with a temperature of the aluminum plate, and wherein the values of the at least one state variable are determined based on the measured values by a temperature model evaluating the measured values.

14. The method as claimed claim 1, further comprising constantly updating the pass schedule.

* * * * *